United States Patent [19]

Nakano

[11] Patent Number: 4,757,589

[45] Date of Patent: Jul. 19, 1988

[54] APPARATUS FOR REMOVING FASTENER MEMBERS FROM A GARMENT FABRIC

[75] Inventor: Katsufumi Nakano, Kurobe, Japan

[73] Assignee: Yoshida Kogyo K. K., Tokyo, Japan

[21] Appl. No.: 899,892

[22] Filed: Aug. 25, 1986

[30] Foreign Application Priority Data

Aug. 30, 1985 [JP] Japan ..... 60-132888[U]

[51] Int. Cl.[4] ..... B25C 7/00

[52] U.S. Cl. ..... 29/243.5

[58] Field of Search ..... 83/140; 30/368; 29/243.5, 243.53, 251, 252

[56] References Cited

U.S. PATENT DOCUMENTS

| | | | |
|---|---|---|---|
| 2,760,574 | 8/1956 | Taylor | 83/140 |
| 3,111,867 | 11/1963 | Riggia | 29/243.5 |
| 3,114,280 | 12/1963 | Schott | 83/140 |
| 3,147,657 | 9/1964 | Williamson | 83/140 |
| 3,779,113 | 12/1973 | Jestin | 83/140 |
| 3,935,772 | 2/1976 | Demus et al. | 83/140 |
| 4,409,720 | 10/1983 | Boudreau | 29/243.5 |
| 4,440,052 | 4/1984 | Weisbeck | 83/140 |

FOREIGN PATENT DOCUMENTS

| | | |
|---|---|---|
| 0129757 | 1/1975 | European Pat. Off. . |
| 1610399 | 4/1971 | Fed. Rep. of Germany . |
| 111023 | 5/1974 | Fed. Rep. of Germany . |
| 543866 | 12/1972 | Switzerland . |

*Primary Examiner*—Robert C. Watson

*Attorney, Agent, or Firm*—Hill, Van Santen, Steadman & Simpson

[57] ABSTRACT

In an apparatus for removing fastener members, from a garment fabric by punching the fastener members, by means of a movable punch and a stationary die, a scrap-piece removal member is carried on a vertically movable punch holder around the punch and movable downwardly relative to the punch, in response to the upward movement of the punch holder, for automatically removing a scrap piece which is stuck to the punch as a result of the punching.

1 Claim, 4 Drawing Sheets

( PRIOR PROBLEM )

APPARATUS FOR REMOVING FASTENER MEMBERS FROM A GARMENT FABRIC

BACKGROUND OF THE INVENTION

1. Title of the Invention

The present invention relates to an apparatus for removing clinched fastener members, such as of a snap button, on the occasion that the latter is attached to a garment fabric in improper position and/or posture.

2. Description of the Prior Art

As shown in FIG. 4 of the accompanying drawings, known apparatus for the concerned purposes generally comprise a stationary die 2 having a vertical hole 3, and a vertically reciprocable punch 1 having at its lower end a cutting blade vertically aligned with the hole 3. In use, clinched male and female fastener members 4, 5 of a snap fastener 6 which is attached to a garment fabric C in improper position and/or posture, are placed on the stationary die 2 in register with the hole 3, whereupon the punch 1 is lowered into the hole 3 of the die 2 to punch or pierce the male and female members 4, 5 along cutting lines (indicated in broken lines) L. A common problem with this prior apparatus is that when the punch 1 return to its upper position after punching, a scrap piece or pieces 7 stick to the punch 1 and must be removed therefrom by hand, which is laborious and time-consuming.

SUMMARY OF THE INVENTION

It is therefore an object of the present invention to provide an apparatus having means for removing fastener members, such as of a snap fastener, from a garment fabric by means of a punch in which apparatus a scrap piece or pieces of the fastener stuck to the punch can be removed therefrom automatically with maximum ease.

According to the present invention, in an apparatus for removing fastener members from a garment fabric by punching the fastener members by means of a movable punch and a stationary die, a scrap-piece removal member is carried on a vertically movable punch holder around the punch and movable downwardly relative to the punch, in response to the upward movement of the punch holder, for automatically removing a scrap piece which is stuck to the punch as a result of the punching.

Many other advantages, features and additional objects of the present invention will become manifest to those versed in the art upon making reference to the detailed description and accompanying sheets of drawings in which a preferred structural embodiment incorporating the principles of the present invention is shown by way of illustrative example.

DETAILED DESCRIPTION

Figure 1:
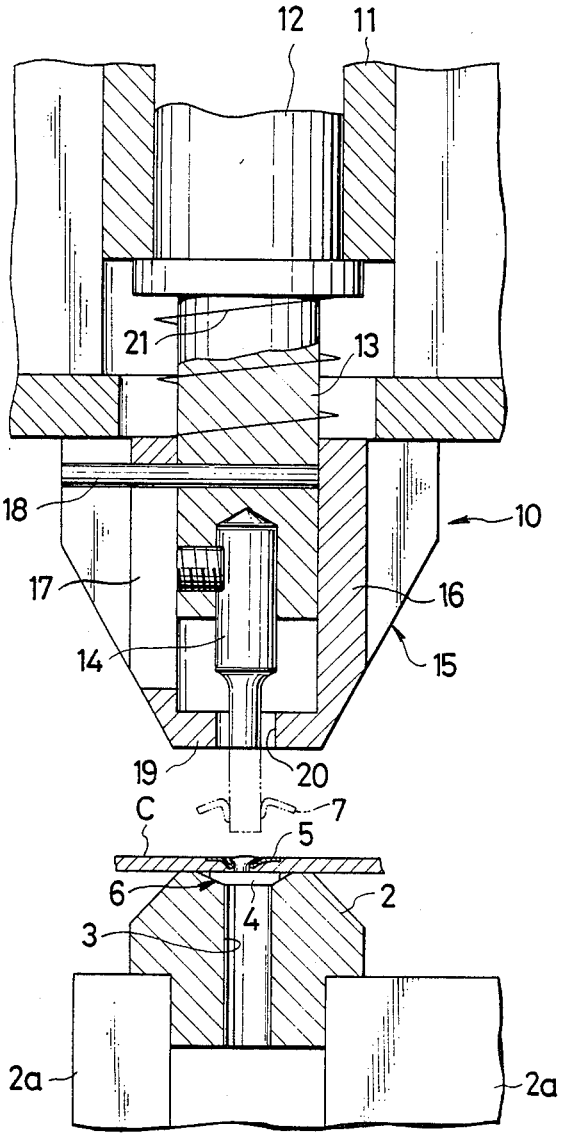
FIG. 1 is a vertical cross-sectional view of a fastener removing apparatus embodying the present invention.

FIG. 1 shows an apparatus for removing clinched male and female fastener members 4, 5, such as of a snap fastener or button 6, attached to a garment fabric C.

The apparatus generally comprises a stationary die 2, and a punch unit 10 disposed above the die 2 and vertically movable toward and away from the die 2.

Figure 2:
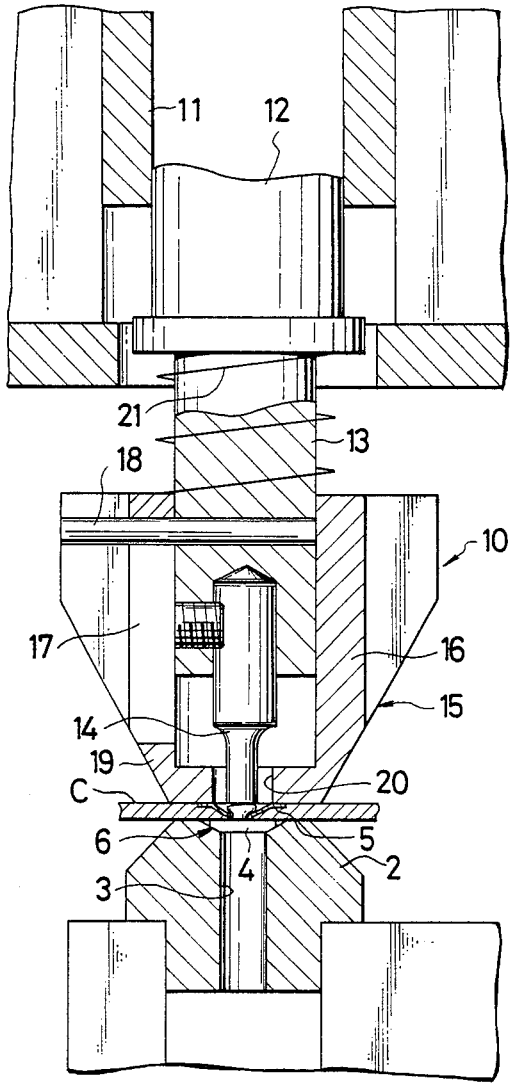
FIGS. 2 and 3 are cross-sectional views similar to FIG. 1, illustrating the mode of operation of the apparatus.
Figure 3:
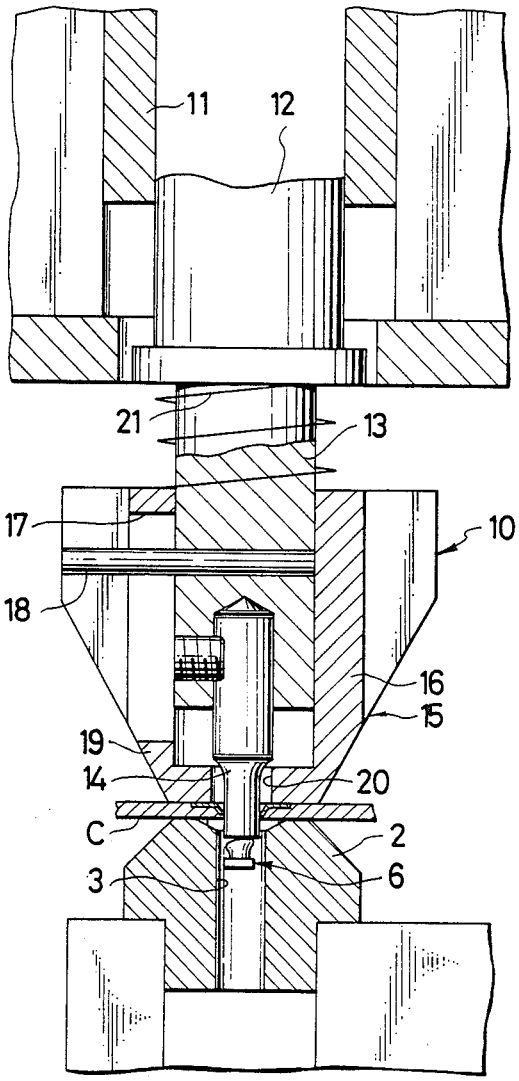
Figure 4:
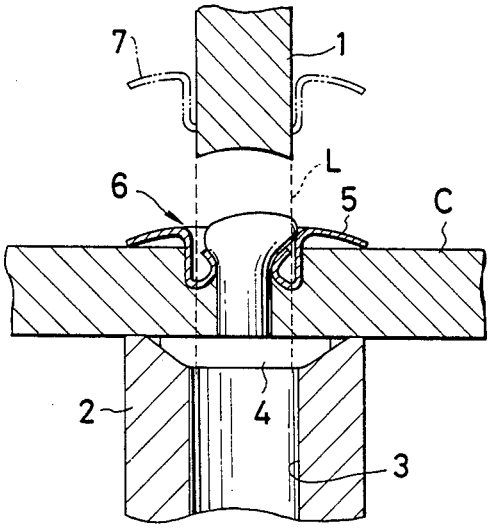
FIG. 4 is a cross-sectional view of a primary part of a prior art apparatus, illustrating a prior problem.

The die 2 is fixedly mounted on a base 2*a* fixedly secured to a frame (not shown) and has a vertical hole 3 of circular cross section opening to a top end surface of the die 2. As illustrated in FIGS. 1–3, the top end surface of the die 2 has a recess surrounding the hole 3 to receive a portion of the fastener or button 6.

The punch unit 10 includes a punch holder 13 fixedly secured to a ram 12 vertically movably supported by a support 11 fixedly secured to the non-illustrated frame. A punch 14 is mounted on a lower end of the punch holder 13 and has at its lower or free end a circular cutting blade in registry with the hole 3 of the die 2. In response to the reciprocating movement of the ram 12, the punch holder 13 is vertically movable toward and away from the die 2 to bring the punch 14 into and out of the hole 3 of the die 2.

The apparatus also includes a scrap-piece removal or stripper member 15 axially slidably mounted on the punch holder 13 and normally urged downwardly toward the die 2 by a compression spring 21 extending around the punch holder 13. The scrap-piece removal member 15 includes a cylindrical wall 16 having at its lower end an inwardly directed annular flange 19 defining a central aperture 20 through which the punch 14 is projectable. The cylindrical wall 16 also has a vertical slot 17 extending parallel to the axis of the cylindrical wall 16. A stop pin 18 is fixedly mounted on the punch holder 13 and is slidably received in the slot 17. The stop pin 18 and the slot 17 jointly restrict the downward movement of the scrap-piece removal member 15; the stop pin 18 is normally disposed at an upper end of the slot 17 under the resilience of the spring 21 as shown in FIGS. 1 and 2, during which time the punch 14 is completely retracted in the scrap-piece removal member 15.

During the returning of the punch 14 from a projected position (indicated in dash-and-two-dot lines in FIG. 1) to a retracted position (indicated in solid lines in FIG. 1), the annular flange 19 is engageable with a scrap piece 7 (which is stuck to the punch 14 as a result of punching or piercing the fastener members 4, 5 by the punch 14 as described below) on the punch 14 so as to remove the scrap piece 7 therefrom.

In the illustrated example, while the stop pin 18 is at the upper end of the slot 17, the lower end surface of the punch 14 is substantially flush with the lower surface of the annular flange 19. Preferably, however, the lower end surface of the punch 14 is slightly retracted from the lower surface of the annular flange 19.

In operation, the clinched male and female fastener members 4, 5 attached to a garment fabric C in improper position and/or posture, are placed on the top surface of the die 2, whereupon the punch 14 and the scrap-piece removal member 15 are lowered initially as a unit from the position of FIG. 1 to the position of FIG. 2 as the punch holder 13 is lowered by the ram 12. In FIG. 2, the lower surface of the annular flange 19 is disposed against the garment fabric C, while the lower end surface of the punch 14 is disposed against the fastener member 4, 5 to be removed.

With continued lowering of the punch holder 13 by the ram 12, only the punch 14 is further lowered from the position of FIG. 2 to the position of FIG. 3 in which the punch 14 projects into the hole 3 of the die 2, thus punching or piercing the fastener members 4, 5. A scrap piece 7 is stuck to the punch 14 as a result of this punching.

Upon completion of the punching, as the punch holder 13 is raised by the ram 12, the punch 14 and the scrap-piece removal member 15 return from the position of FIG. 3 to the position (shown in solid lines) of FIG. 1, with the scrap piece 7 stuck to the punch 14. During that time the scrap-piece removal member 15 is moved downwardly relative to the punch holder 13 and hence the punch 14 under the resilience of the spring 21, that is, the punch 14 is moved from the projected position (solid lines in FIG. 1). When the punch 14 is retracted into the central aperture 20 of the scrap-piece removal member 15, the scrap piece 7 stuck to the punch 14 is blocked by the annular flange 19 from entering the central aperture 20 and is hence removed from the punch 14.

According to the present invention, since the scrap piece 7 stuck to the punch 14 is blocked by the annular flange 19 of the scrap-piece removal member 15 around the punch 14 as the latter is returned to its raised position, by the spring 21 and gravity the scrap piece 7 can be removed from the punch 14 smoothly without any assistance of the operator's hand.

Although various minor modifications may be suggested by those versed in the art, it should be understood that I wish to embody within the scopes of the patent warranted hereon, all such embodiments as reasonably and properly come within the scope of my contribution to the art.

What is claimed is:

1. An apparatus having means for removing fastener members from a garment fabric, said means comprising:

(a) a stationary die for supporting on its top end surface the fastener members and having a vertical hole opening to said top end surface, said top end surface having a recess surrounding said hole;

(b) a punch holder disposed above said die and vertically movable toward and away from said die;

(c) a punch mounted on a lower end of said punch holder and movable, in response to the vertical movements of said punch holder, into and out of said hole of said die for punching the fastener members supported on said die and causing a scrap-piece of the punched fastener members to be stuck to said punch; and (d) a scrap-piece removal member carried on said punch holder around said punch including a cylindrical wall having at its lower end an inwardly directed annular flange defining a central aperture through which said punch is projectable from and is retractable into said scrap-piece removal member, said scrap-piece removal member being normally urged by a spring for downward movement of said scrap-piece removal member relative to upward movement of said punch holder and hence said punch, said cylindrical wall having a vertical slot slidably receiving a stop pin mounted on said punch holder for restricting the downward movement of said scrap-piece removal member relative to said punch holder and hence said punch, a lower end surface of said punch being no lower than substantially flush with a lower surface of said annular flange when said stop pin is disposed at an upper end of said vertical slot of said cylindrical wall for removing the scrap-piece which is stuck to said punch as a result of the above-mentioned punching.

* * * * *